US007038381B2

(12) United States Patent
Nakao

(10) Patent No.: US 7,038,381 B2
(45) Date of Patent: May 2, 2006

(54) HALOGEN LAMP AND METHOD OF ITS MANUFACTURE

(75) Inventor: Hiroto Nakao, Wakayama (JP)

(73) Assignee: Noritsu Koki Co., Ltd., Wakayama-ken (JP)

( * ) Notice: Subject to any disclaimer, the term of this patent is extended or adjusted under 35 U.S.C. 154(b) by 68 days.

(21) Appl. No.: 10/351,232

(22) Filed: Jan. 24, 2003

(65) Prior Publication Data

US 2003/0142495 A1 Jul. 31, 2003

(30) Foreign Application Priority Data

Jan. 25, 2002 (JP) ..... 2002-016396

(51) Int. Cl.
*H01K 1/18* (2006.01)

(52) U.S. Cl. ..... 313/579; 313/271; 313/578

(58) Field of Classification Search ..... 313/271–279, 313/379, 315, 316, 628, 574, 269, 491, 579, 313/631

See application file for complete search history.

(56) References Cited

U.S. PATENT DOCUMENTS 6,784,605 B1 * 8/2004 Sakai et al. ..... 313/579

FOREIGN PATENT DOCUMENTS

| | | |
|---|---|---|
| JP | 46-4090 | 11/1971 |
| JP | 62-191060 | 12/1987 |
| JP | 1-155255 | 10/1989 |
| JP | 02-181358 | 7/1990 |
| JP | 03-067456 | 3/1991 |
| JP | 08-185833 | 7/1996 |
| JP | 10-106509 | 4/1998 |

* cited by examiner

*Primary Examiner*—Ashok Patel
(74) *Attorney, Agent, or Firm*—Fulbright & Jaworski L.L.P.

(57) ABSTRACT

A halogen lamp includes a pair of lead members, a filament bonded to and between the pair of lead members and a glass bulb encasing and sealing the filament and at least portions of the pair of lead members. The lamp further includes a support member made of non-conductive material and adapted for fixedly interconnecting legs of the pair of lead members, with the support member being disposed within the glass bulb. The lead members and the filament are bonded together by plasma welding.

4 Claims, 10 Drawing Sheets

HALOGEN LAMP AND METHOD OF ITS MANUFACTURE

BACKGROUND OF THE INVENTION

1. Field of the Invention

The present invention relates to a halogen lamp including a pair of lead members, a filament bonded to and between the paired lead members, and a glass bulb sealing the filament and at least portions of the paired lead members. The invention relates also to a method of its manufacture.

2. Description of the Related Art

Conventionally, in such halogen lamp, the bonding between the filament and the pair of lead members was effected by spot welding. And, as illustrated in FIG. 10, in the spot welding of the conventional halogen lamp, first, coiled opposed ends of the filament 52 are engaged or overlapped on free ends of the respective lead members 53*a*, 53*b* over a length of some millimeters so as to provide a temporary loose connection between the lead members 53*a*, 53*b* and the filament 52. Then, a spot welding operation is effected for welding the overlapped portions of the lead members 53*a*, 53*b* and filament 52 excluding the leading end and its vicinity of the respective lead member 53*a*, 53*b*. Therefore, during illumination of the lamp in use, there would occur repeated rapid cycles of contact and detachment at this portion, which result in intermittent illumination (flickering phenomenon). Such flickering phenomenon is problematic in particular if the halogen lamp is employed as a scanning beam source for use with e.g. CCD (charge-coupled device) receiving its transmission beam, in scanning (especially high-speed scanning) photographic film image data and converting them into digital image data, since the flickering appears as a noise on the read data, thus hindering high-precision scanning.

In the conventional construction, as described above, the welding is effected on the mutually overlapped portions of the lead members 53*a*, 53*b* and filament 52 excluding the leading end and its vicinity of the respective lead member 53*a*, 53*b*. Its intension is to restrict inadvertent detachment or failure of the welding due to repeated application of tensile or torsion stress thereto from the lead members 53*a*, 53*b* by means of the bonding at the overlapped portions.

Further, the conventional manufacture method of halogen lamp is carried out in the following manner.

First, predetermined portions (e.g. portions denoted with y, y in FIG. 10) of the legs of the lead members 53*a*, 53*b* are pinched and supported by a dedicated jig or the like, thereby to fix the lead members 53*a*, 53*b* in position relative to each other. Next, opposed coiled ends of the filament 52 are engaged on the respective terminal ends of the lead members 53*a*, 53*b* each over a length of some millimeters, thereby to provide temporary retention between the lead members 53*a*, 53*b* and the filament 52; and subsequently the filament 52 and the respective lead members 53*a*, 53*b* are welded together in the manner described above. Thereafter, the filament 52 and portions of the lead members 53*a*, 53*b* welded thereto are inserted into a glass bulb 51 charged and kept in a heating furnace. Then, the base end of this heat-fused glass bulb is collapsed from opposed ends thereof by means of e.g. a metal mold, thereby to seal the bottom end of the glass bulb 51. Further, the top end of this glass bulb 51 is closed while drawing air from inside the glass bulb and charging instead halogen gas therein. Lastly, the base end of the resultant glass bulb assembly 1 is loosely positioned relative to a socket 20 made of e.g. metal in such a manner as to achieve optimal positional relationship between the filament 52 and the socket 20. Upon this achievement, refractory cement 22 or the like is charged into the gap formed between the socket 20 and the base end of the glass bulb 51 for their permanent fixation.

According to the above-described conventional method of manufacture, however, even if the optimal relative positional relationship between the lead members 53*a*, 53*b* is once realized by using the dedicated jig for pinching and supporting the predetermined portions y, y of their legs, this relative position may be subsequently changed in an inadvertent or uncontrolled manner in the course of the above-described subsequent operation for collapsing the base end of the fused glass bulb form the opposed sides thereof by means of mold or another metal tool. This, if happens, will lead to unexpected change in the posture and/or shape of the filament 52 connected to the terminal ends of the lead members 53*a*, 53*b*, thus making it difficult to foresee the actual center of illumination (incandescent center) of the lamp in use, and/or making it difficult to position the glass bulb 51 assembly and the socket 20 in an appropriate relationship relative to each other. Consequently, sufficiently high production yield cannot be obtained.

Incidentally, in the conventional manufacture of halogen lamp, plasma welding method (described later) was not employed for the bonding between the lead members and the filament for the following reason. Namely, in the course of the sealing operation of the base end of the glass bulb while heating it, the relative position between the leading ends of the lead members is apt to be changed as described above. Hence, with implementation of the plasma welding operation alone (without providing any "anti-displacement measure" such as providing a temporary retention construction between the lead members and the filament), the welded portions tend to fail in the course of this sealing operation.

SUMMARY OF THE INVENTION

In view of the above-described drawback of the conventional halogen lamp, a first object of the present invention is to provide an improved halogen lamp capable of eliminating or at least effectively restricting occurrence of the flickering phenomenon due to contact trouble between the filament and the lead members.

In view of the above-described drawback of the conventional method of manufacturing a halogen lamp, a second object of the invention is to provide an improved manufacture method for a halogen lamp which method can eliminate or at least effectively restrict occurrence of change in the posture and/or shape of the filament which was once fixed by means of the jig supporting the lead members in the course of the subsequent manufacturing process of the lamp.

For accomplishing the first object, the present invention proposes a halogen lamp having the characterizing features set forth in claims 1 and 2.

Namely, a halogen lamp, according to claim 1, comprises:

a pair of lead members;

a filament bonded to and between the pair of lead members;

a glass bulb encasing and sealing the filament and at least portions of the pair of lead members; and a support member made of non-conductive material and adapted for fixedly interconnecting legs of the pair of lead members, said support member being disposed within said glass bulb;

wherein said lead members and the filament are bonded together by plasma welding.

With the halogen lamp having the above features of claim 1, the relative position and/or posture of the leading ends of the lead members can be reliably maintained and fixed by means of the support member adapted for fixedly interconnecting legs of the pair of lead members. Therefore, this construction allows for implementation of plasma welding between the lead members and the filament which was not possible heretofore with the convention. The construction allows, in effect, "end-to-end" bonding between the lead members and the filament at the respective leading ends thereof, eliminating the conventional arrangement of engaging the coiled portions of the former on the latter. Consequently, the invention has provided a halogen lamp which can effectively restrict the occurrence of the flickering phenomenon due to the contact problem between the filament and the lead members.

Preferably, during illumination of the halogen lamp, a halogen cycle is generated in which tungsten evaporated from the heated filament will react with the halogen gas within the glass bulb to form tungsten-halogen compound, which then will be decomposed in the vicinity of the filament and return thereto; and the support member is disposed out of a convection area of said compound in the halogen cycle.

The above-described construction restricts deposition of the tungsten-halogen compound or the tungsten in the course of its convection. As a result, the construction will eliminate or restrict such problems of gradual thinning of the filament or shortage of the halogen gas within the glass bulb in association with the halogen cycle.

For accomplishing the further object, the invention's method of manufacturing a halogen lamp has the features set forth in claims 3–7.

Namely, a method of manufacturing a halogen lamp, according to claim 3, comprises the steps of:

fixedly interconnecting legs of a pair of lead members with a support member made of non-conductive material, said lead members being fixed to a jig in advance;

welding a filament to and between said pair of lead members whose legs were fixedly interconnected to each other in the fixedly interconnecting step; and disposing a glass bulb so as to enclose at least the filament welded to the paired lead members and the support member and subsequently sealing portions of the paired lead members by sealing a base end of the glass bulb with clamping the paired lead members therein.

With the method relating to claim 3 having the above-described features, the setting of the relative position and posture of the leading ends of the legs of the paired lead members may be effected in a reliable manner by using the double support construction provided by the support of the lead members by the jig, and the further support thereof from the support member which was fixedly connected thereto in the preceding step. Thus, the subsequent welding step for the filament may be carried out smoothly and reliably This double support construction allows also for the reliability and smoothness in the step of sealing the base end of the glass bulb. As a result, this construction can limit the possibility of inadvertent change in the relative position or posture of the leading ends of the legs of the pair of lead members due to application thereto of an external force from a mold or the like used for the sealing operation. Consequently, the construction can avoid such problems as detachment of the filament, once bonded in the welding step, in the course of the subsequent sealing step or the inadvertent change in the relative position or posture of the leading ends of the legs of the pair of lead members due to application thereto of an external force from a mold or the like used for the sealing operation. As a result, the production yield of the halogen lamps can be improved.

Similarly, the invention's method of manufacturing a halogen lamp according to claim 4, comprises the steps of:

welding a filament to and between the pair of lead members fixed to a jig;

fixedly interconnecting respective legs of the pair of lead members welded to the filament in the welding step with a support member made of non-conductive material; and disposing a glass bulb so as to enclose at least the filament welded to the paired lead members and the support member and subsequently sealing portions of the paired lead members by sealing a base end of the glass bulb with clamping the paired lead members therein.

With the method relating to claim 4 having the above-described features, the sealing operation of the base end of the glass bulb may be effected under the advantageous condition in which the relative position and posture of the leading ends of the legs of the paired lead members may be fixedly maintained by using the double support construction provided by the support of the lead members by the jig, and the further support thereof from the support member which was fixedly connected thereto in the preceding step. As a result, this construction can limit the possibility of inadvertent change in the relative position or posture of the leading ends of the legs of the pair of lead members due to application thereto of an external force from a mold or the like used for the sealing operation. Consequently, the construction can avoid such problems as detachment of the filament, once bonded in the welding step, in the course of the subsequent sealing step or the inadvertent change in the relative position or posture of the leading ends of the legs of the pair of lead members due to application thereto of an external force from a mold or the like used for the sealing operation. As a result, the production yield of the halogen lamps can be improved.

In the above, in the step for fixedly interconnecting respective legs of the pair of lead members welded to the filament in the welding step with a support member made of non-conductive material, the external force required is smaller than the external force used for the step of sealing the base end of the glass bulb. Hence, the risk of inadvertent change in the relative position or posture of the leading ends of the legs of the lead members will be relatively small. Therefore, even if this fixedly interconnecting step is effected after the filament welding step, such problems of detachment of the filament (welded in the welding step) in the course of the fixedly interconnecting step or inadvertent change in the posture or position of the filament of the filament relative to the lead members are not likely to occur.

Moreover, in the case of the manufacturing method according to claim 4, after completion of the welding of the filament, the two subsequent step involving heating, namely, the step of fixedly interconnecting the legs of the paired lead members welded to the filament with the support member made of non-conductive material (e.g. glass) and the step of sealing the base end of the glass bulb with clamping the pair of lead members therein, can be carried out in succession (e.g. within the heating furnace). Otherwise, the process would be more complicated and troublesome, requiring effecting first the fixedly interconnecting step for the legs of the lead members welded to the filament with the support member within the heating furnace, then taking the assembly temporarily out of the heating furnace in order to effect the welding of the filament to and between the paired lead members; and charging the resultant assembly back into the heating furnace in order to effect the sealing operation of the base end of the glass bulb with sealing portions of the paired lead members.

Preferably, said welding step is effected for welding the filament to and between the opposed leading ends of the pair of lead members.

This construction allows for realization of a halogen lamp without the problematic arrangement requiring the temporary loose engagement of filament portions over the leading ends of the lead members. Accordingly, the construction eliminates the troublesome and difficult step required by the convention for engaging the very thin coiled portions of the filament over the respective leading ends of the lead members. At the same time, with the halogen lamp provided by this construction, the flickering phenomenon due to interrupted contact between the filament portions and the lead members will hardy occur.

Moreover, the above construction allows advantageous utilization of the entire length of the mounted filament for illumination, thus contributing to cost reduction. Further advantages resulting from this construction include possibility of precision setting of the light quantity of the lamp during its illumination, possibility of precision setting of the center of beam source in the subsequent step for connecting the finished glass bulb with a socket. It should be noted that in the case of this construction, the welding need not be the plasma welding, but may be other type of welding including the spot welding.

Still preferably, the welding step is effected as plasma welding.

Compared with the spot welding, the plasma welding provides the advantages of lower electric resistance and improved visibility in checking the welded condition upon completion of the welding operation (in the case of the spot welding employed by the convention, the bonding, i.e. welding takes place on the inner face of the filament fitted in the tubular form over the lead members, thus the visibility of the bonded condition was poor).

Still preferably, in the fixedly interconnecting step, the legs of the paired lead members fixed to a predetermined jig are welded to each other by clamping the lead members from opposed sides thereof with a pair of glass rods as said support member made of non-conductive material.

With the above construction, the pair of glass rods whose opposed faces have been fused sufficiently will be simultaneously brought closer to the legs of the lead members and then the glass rods will be slightly pressed against each other to be bonded. Hence, the interconnecting operation and the sealing operation of the lead members within the glass bulb can be carried out without applying significant external force to the legs of the lead members. thus further reducing the risk of inadvertent change in the relative position and/or posture of the leading ends of the legs of the paired lead members.

Further and other objects, features and advantages of the invention will become apparent upon reading the following disclosure of the preferred embodiments thereof with reference to accompanying drawings.

DESCRIPTION OF PREFERRED EMBODIMENTS

A halogen lamp and its method of manufacture both relating to the present invention will now be described in details with reference to the accompanying drawings.

(Construction of Halogen Lamp)

Figure 1:
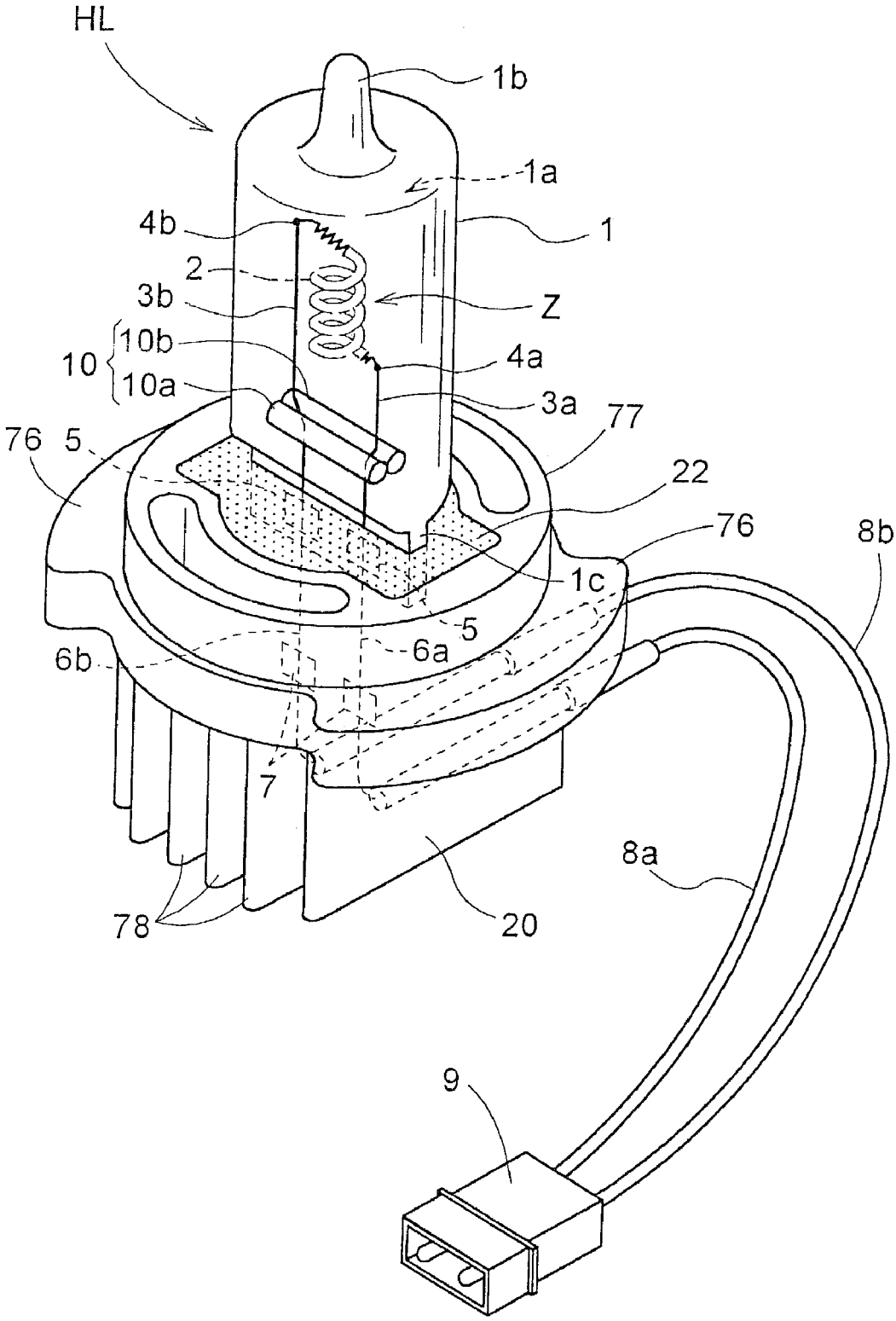
FIG. 1 is a perspective view of a halogen lamp relating to the present invention.
Figure 2:
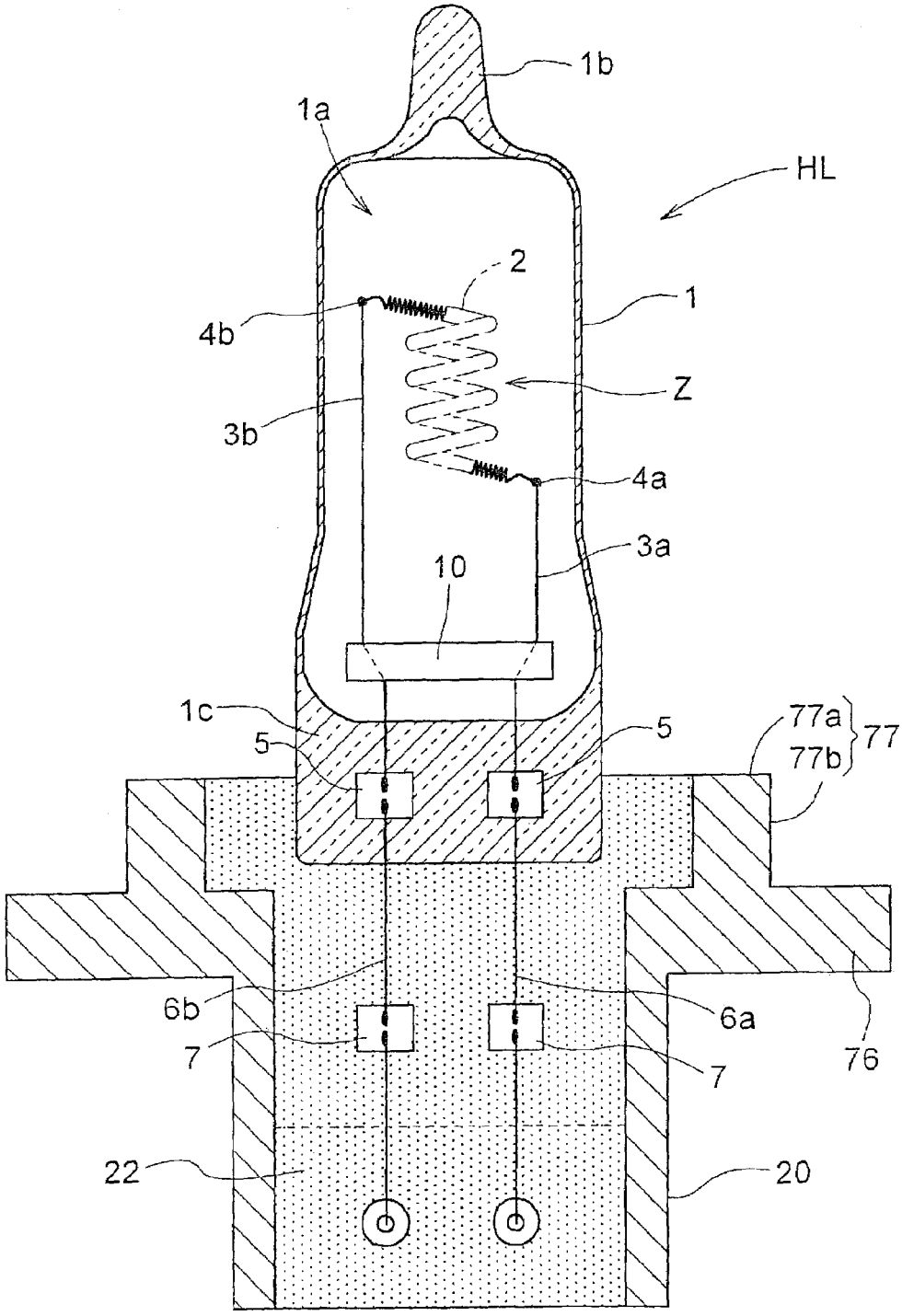
FIG. 2 is a partially cutaway front view of the halogen lamp shown in FIG. 1.
Figure 3:
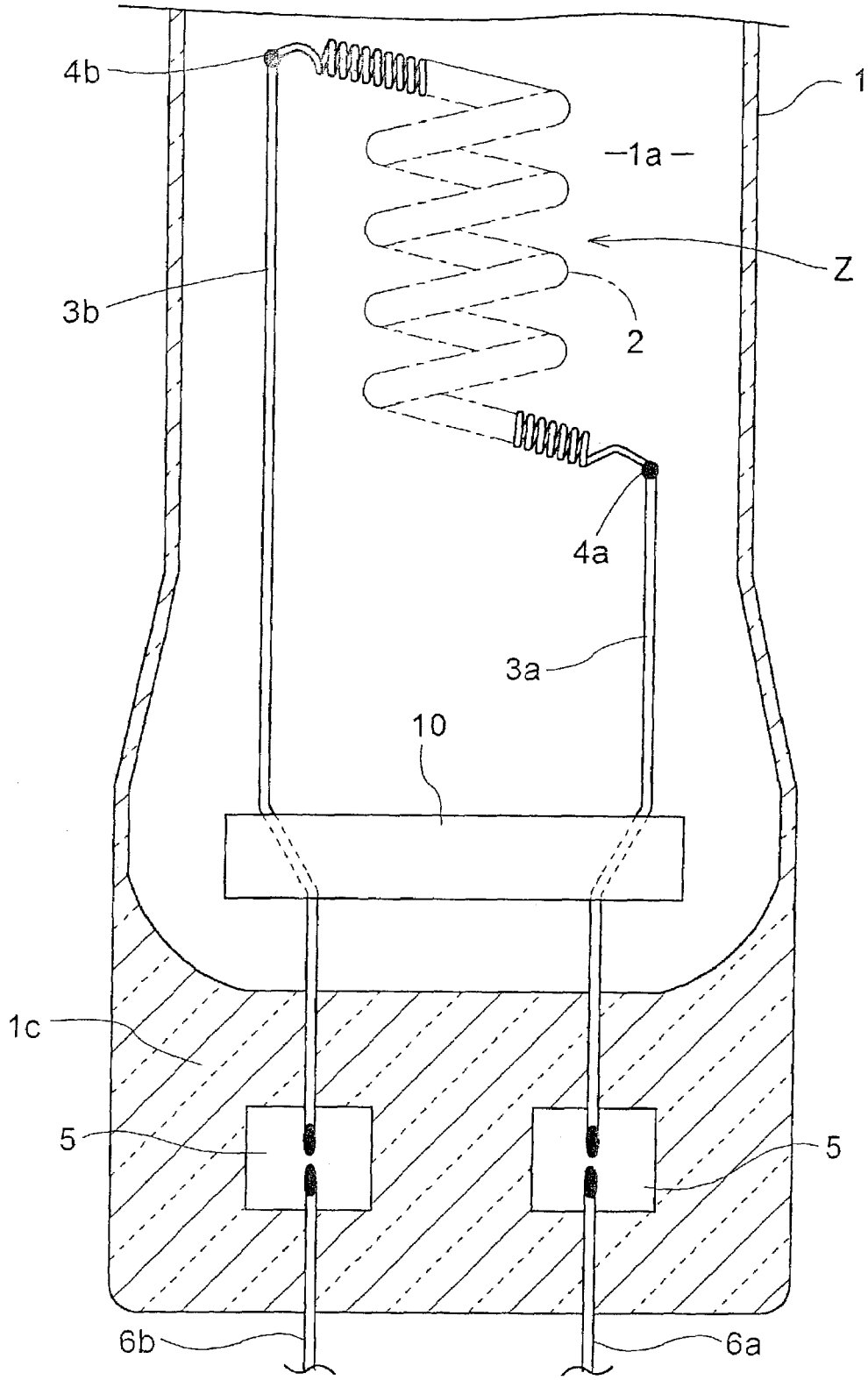
FIG. 3 is a partial enlarged view of the halogen lamp shown in FIG. 2.

A halogen lamp HL shown in FIGS. 1 through 3 includes a pair of inner lead bars 3*a*, 3*b* (example of pair of lead members), a single filament 2 bonded to and between respective leading ends of the inner lead bars 3*a*, 3*b*, and a glass bulb 1 encasing and sealing portions of the lead bars 3*a*, 3*b* and the filament 2. The filament 2 is a double-helix member made of tungsten.

Respective base ends of the inner lead bars 3*a*, 3*b* are fixedly bonded via molybdenum foils 5, 5 to leading ends of a pair of outer lead bars 6*a*, 6*b* by means of plasma welding. On the other hand, the leading ends of the outer lead bars 6*a*, 6*b* are appropriately connected to coated flexible cables 8*a*, 8*b* via e.g. crimp terminals 7, 7 whose base ends are connected in turn to a plug 9 made of resin.

A base end 1*c* of the glass bulb 1 is sealed by heat fusing, with clamping longitudinal portions of the inner lead bars 3*a*, 3*b* and outer lead bars 6*a*, 6*b* as well as the molybdenum foils 5, 5 interconnecting the inner and outer bars. A top end 1*b* of the glass bulb 1 is also sealed by means of fusing, with enclosing halogen gas within inside 1*a* of the glass bulb 1.

The pair of legs of the inner lead bars 3*a*, 3*b* disposed within the inside 1*a* of the glass bulb 1 completely sealed in the manners described above are fixedly connected to each other via a glass rod 10 (example of a support member made of non-conductive material). The rod 10 comprises an assembly of a pair of rods 10*a*, 10*b* formed by bringing sufficiently fused opposing faces of thereof simultaneously closer to the legs of the inner lead bars 3*a*, 3*b* and then pressing the former to the latter, thereby to integrate the rods together with fixedly retaining the legs of the inner lead bars 3*a*, 3*b* therebetween.

Further, the leading ends of the inner lead bars 3*a*, 3*b* and the opposed ends of the filament 2 are bonded to each other by means of plasma welding, without employing the conventional arrangement of engaging the coiled portions of the former on the leading ends of the latter. During this plasma welding, there occur simultaneous heat fusion of the components of the inner lead bars 3*a*, 3*b* and of the filament 2 and as these components are well fused and mixed together, thereby to provide spherical bonded portions 4*a*, 4*b* visible from outside.

The sealed base end 1*c* of the glass bulb 1 is contained within the socket 20 made of e.g. aluminum die cast. And, refractory cement 22 is charged around the base end 1*c* for fixedly bonding them together.

During illumination of the halogen lamp HL there will be generated a halogen cycle in which the tungsten evaporated from the heated filament 2 will react with the halogen gas within the glass bulb 1 to form tungsten-halogen compound, which then will be decomposed in the vicinity of the filament 2 by the heat and return thereto. Then, in order not to interfere with this cycle or, more specifically, in order to avoid deposition of the evaporated compound or tungsten on the glass rod 10 fixedly interconnecting the legs of the inner lead bars 3*a*, 3*b*, the glass rod 10 is disposed at a lower position sufficiently clear of a convection area of the compound or tungsten.

(Method of Manufacturing the Halogen Lamp)

The halogen lamp HL shown in FIGS. 1–3 can be manufactured by an exemplary method described next.

Figure 4:
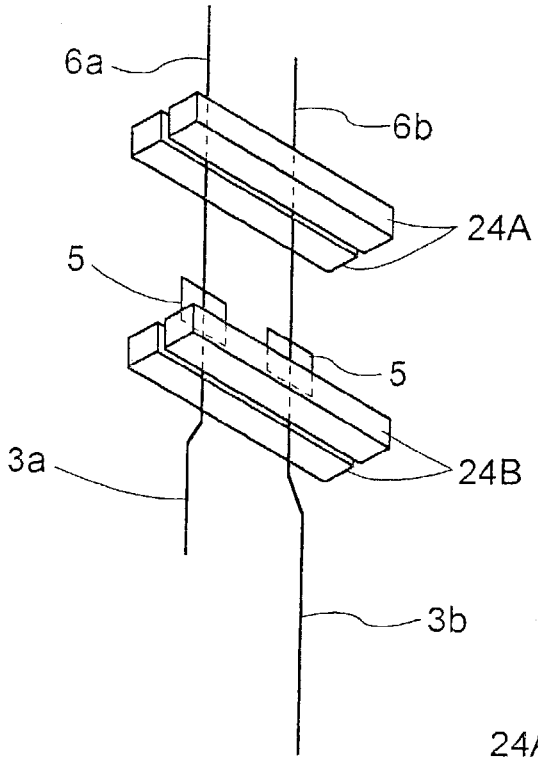
FIG. 4 is a perspective view illustrating a part of a method of manufacturing a halogen lamp also relating to the present invention.
Figure 4:
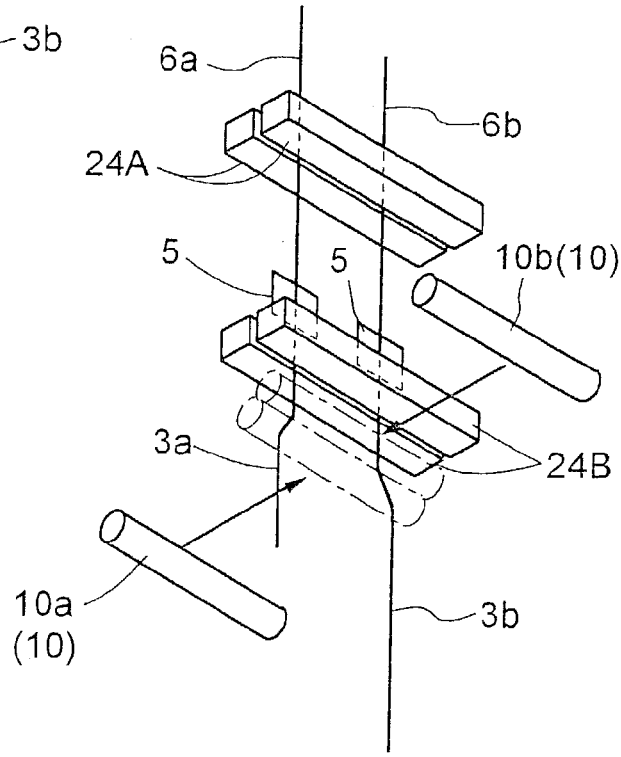

(1) As shown in FIG. 4(*a*), the inner lead bars 3*a*, 3*b* and the outer lead bars 6*a*, 6*b* which were bonded to each other via the molybdenum foils 5, 5 by the plasma welding are fixed to jigs 24A, 24B. The jig 24A serves to fix the relative position and posture of the outer lead bars 6*a*, 6*b*. The other jig 24B serves the fix the relative position and posture of the inner lead bars 3*a*, 3*b*. With these, the relative position and the posture of the leading ends of the inner lead bars 3*a*, 3*b* can be fixed sufficiently.

(2) Then, as illustrated in FIG. 4(*b*), the respective legs of the inner lead bars 3*a*, 3*b* will be fixedly interconnected to each other with the glass rod 10. Specifically, in this process, the pair of glass rods 10*a*, 10*b* having mutually opposed faces thereof sufficiently fused by heat will be brought closer simultaneously from the opposed sides toward the legs of the inner lead bars 3*a*, 3*b* and then slightly pressing the pair of glass rods 10*a*, 10*b* against each other for bonding these together with retaining the portions of the legs of the lead members between the glass rods. With these, the relative position and the posture of the leading ends of the inner lead bars 3*a*, 3*b* can be fixed even more sufficiently.

Figure 5:
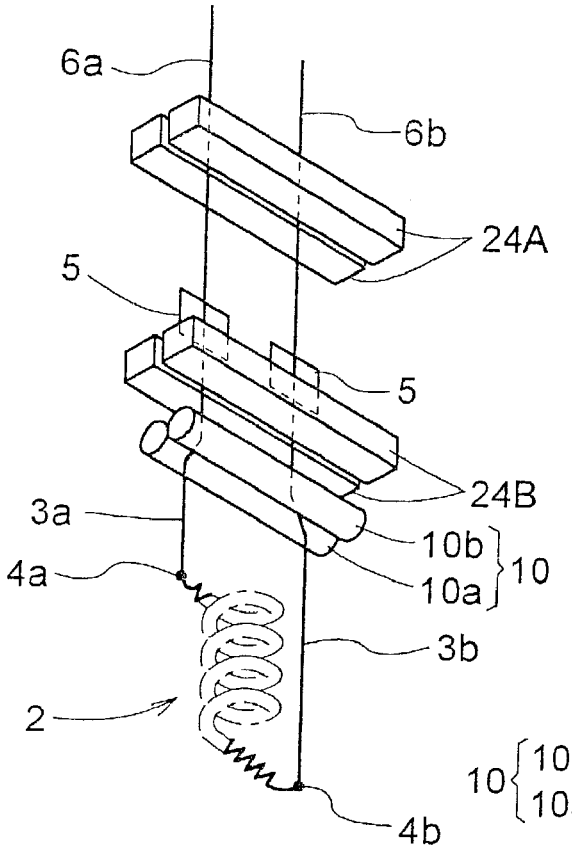
FIG. 5 is a perspective view illustrating a further part of the invention's method.
Figure 5:
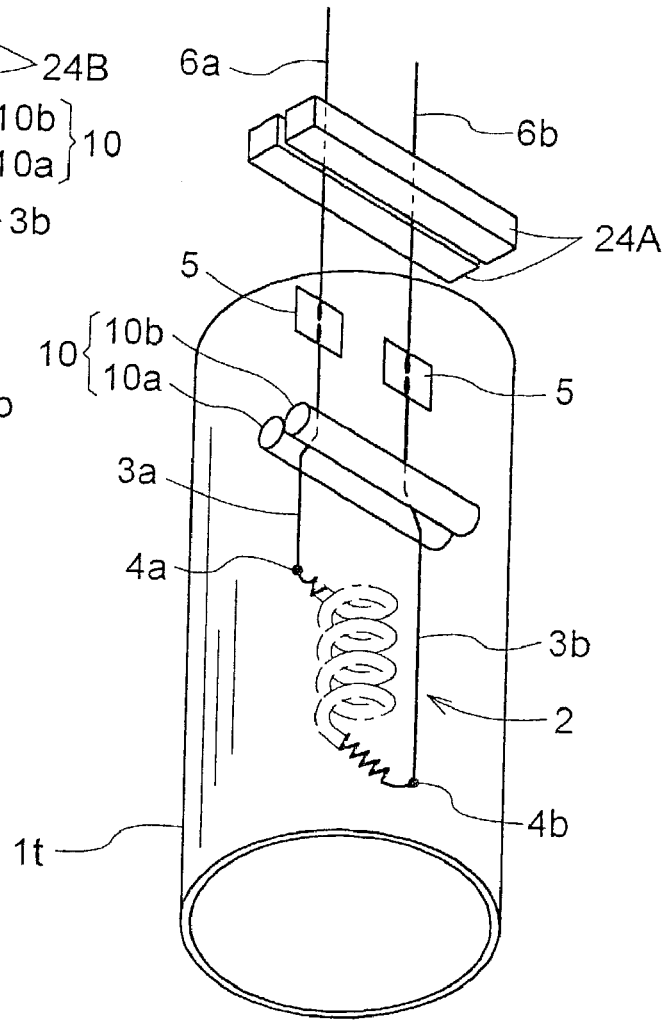

(3) As illustrated in FIG. 5(*a*), the filament 2 will be bonded to and between the leading ends of the inner lead bars 3*a*, 3*b*. Specifically, the respective leading ends of the inner lead bars 3*a*, 3*b* and the opposed terminal ends of the filament 2 are bonded to each other by means of plasma welding. This process avoids the conventional arrangement of engaging the coiled portions of the filament 2 over the leading ends of the inner lead bars 3*a*, 3*b*. During this plasma welding, there occur simultaneous heat fusion of the components of the inner lead bars 3*a*, 3*b* and of the filament 2 and as these components are well mixed together, thereby to provide the spherical bonded portions 4*a*, 4*b*.

(4) Then, as illustrated in FIG. 5(*b*), the jig 24B which has supported the inner lead bars 3*a*, 3*b* will now be removed. And, the glass bulb 1*t* with its opposed ends sill open will be fitted to enclose at portions of the inner lead bars 3*a*, 3*b* and the entire filament 2.

Figure 6:
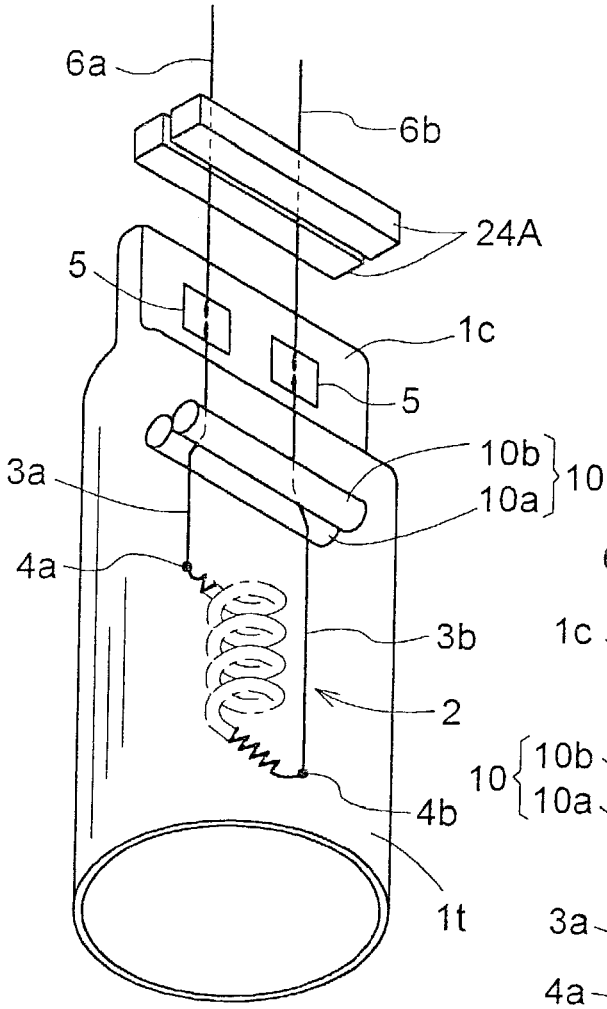
FIG. 6 is a perspective view illustrating a still further part of the invention's method.
Figure 6:
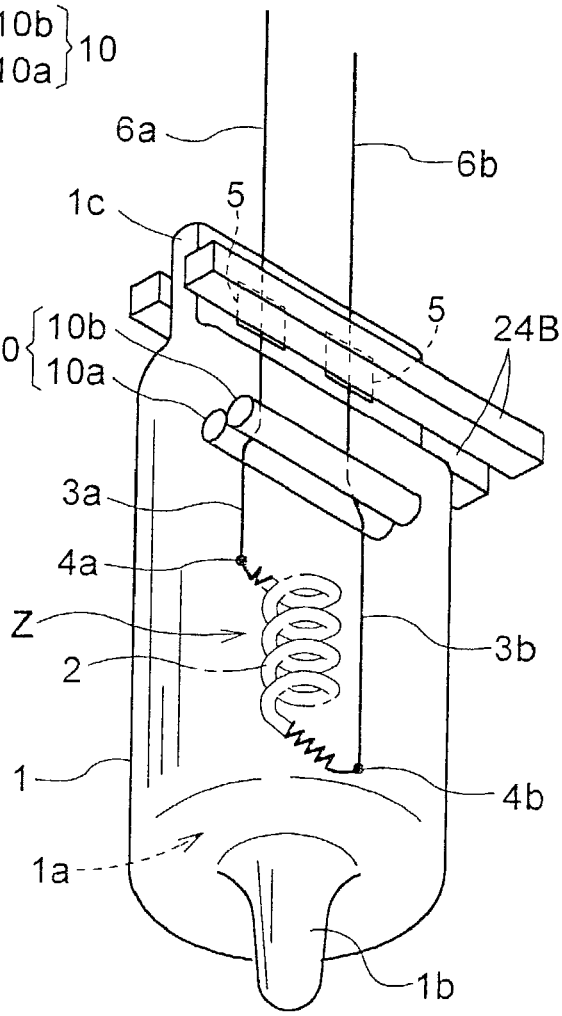

(5) As illustrated in FIG. 6(*a*), under the above-described enclosing condition, the glass bulb 1*t* will be heated, with emphasis in particular at its base end. In succession and under this heated condition, the base end of the glass bulb 1*t* will be sealed by heat fusing. Specifically, this sealing operation is effected by collapsing the heat-fused base end of the glass bulb 1*b* from the opposed sides thereof by means of e.g. a pair of metal molds. With this sealing operation, the sealed base end of the glass bulb 1*t* will enclose therein the entire molybdenum foils 5, 5 as well as the limited portions of the inner lead bars 3*a*, 3*b* and outer lead bars 6*a*, 6*b*. As this sealing operation is carried out with the legs of the inner lead bars 3*a*, 3*b* being fixedly interconnected by the glass rod 10, occurrence of inadvertent or uncontrolled change in the relative position and/or posture of the leading ends of the inner lead bars 3*a*, 3*b* due to application thereto of the external force supplied from the metal molds or the like used for the sealing operation may be effectively restricted.

(6) After evacuating the inside of the glass bulb 1*t* which is sealed only at its base end to a required level of vacuum, halogen gas is charged therein and heating is effected again to be directed this time to the top end of the glass bulb 1*t*.

(7) As illustrated in FIG. 6(*b*), the heat-fused top end of the glass bulb 1*t* will be sealed by heat fusing, with gripping the sealed base end of the bulb 1*t* with e.g. the jig 24B, whereby the glass bulb 1 will be completed.

(8) Upon its completion, the glass bulb 1 will be removed from the jig 24B. Then, the free base ends of the outer lead bars 6*a*, 6*b* will be connected to flexible covered wires 8*a*, 8*b* by connecting means such as the crimp terminals 7, 7 (see FIGS. 1 and 2). In this, the base ends of the covered wires 8*a*, 8*b* have been connected with the resin plug 9 in advance.

(9) Then, the glass bulb 1 will be mounted to the socket 20. In doing this, first, a particular condition will be looked for in which the base end 1*c* of the glass bulb 1 is inserted into the socket 20 and incandescent center Z of the filament 2 is located at a predetermined position relative to the socket 20 and then under this condition the bulb 1 and the socket 20 are fixedly assembled to each other (for this fixing, an unillustrated appropriate jig will be used). Then, at a gap formed between the interior of the socket 20 and the base end 1*c* of the glass bulb 1 inserted therein, the refractory cement 22 in the form of slurry or paste will be filled and the cement 22 will then be cured for hardening. With this, there is realized a condition that only the covered wires 8*a*, 8*b* and the resin plug 9 extend from the hardened refractory cement 22 inside the socket 20.

Incidentally, when this halogen lamp HL is employed as a beam source for a film scanner of a type operable to effect line-scanning operation along a sub scanning direction on a photographic film relative to a linear CCD extending along a main scanning direction, the following fact should be pointed out. Namely, while it is also important for the incandescent center Z not to be displaced radially from the axis of the glass bulb 1 (this axis is substantially parallel to the extending direction of the inner lead bars 3*a*, 8*b* and the outer lead bars 6*a*, 6*b*), more important is the distance (measured in millimeters) of the position thereof relative to the socket 20 along the axis of the glass bulb 1. In other words, the position of the incandescent center Z relative to the vertical direction in FIG. 3 is essential.

(Exemplary Use of the Halogen Lamp)

Figure 7:
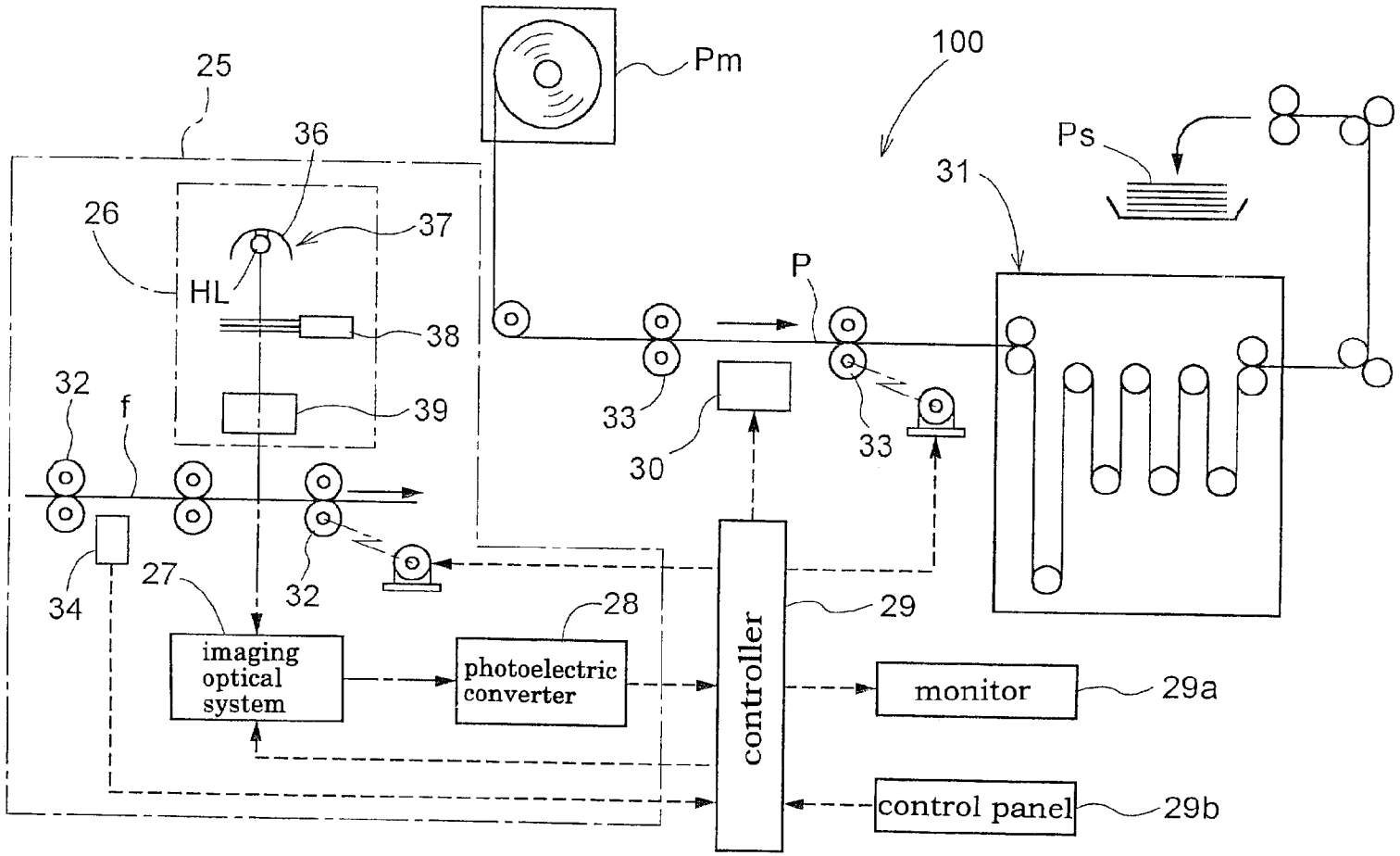
FIG. 7 is a block diagram showing principal construction of a silver salt photography digital printer using the invention's halogen lamp.

FIG. 7 is a schematic block diagram of a sliver-salt photography digital printer 100. A beam source unit 37 including the halogen lamp HL according to the invention is incorporated within a film scanner device 25 as one component of this digital printer 100.

The film scanner device 25 includes an illuminating optical system 26, an imaging optical system 27, and a photoelectric converter 28 having a CCD sensor. Digital image data obtained by the film scanner device 25 are transmitted to a controller 29, where the data are used by a digital printing unit 30 for printing an image on a print paper P. The controller 29 is connected to a monitor 29*a* for displaying various processing information, a control panel 29*b* for allowing inputs of various processing instructions, etc.

As an engine for use with such digital printing unit 30, various types are known, including liquid crystal shutter type, CRT type, fluorescent tube type. In the instant embodiment, the unit 30 employs a line exposing print head using the liquid crystal shutter type construction. The print paper P printed by the digital printing unit 30 will then undergo a developing process at a developing unit 31, a drying process and then discharged as prints Ps cut in pieces for respective frame images.

Figure 8:
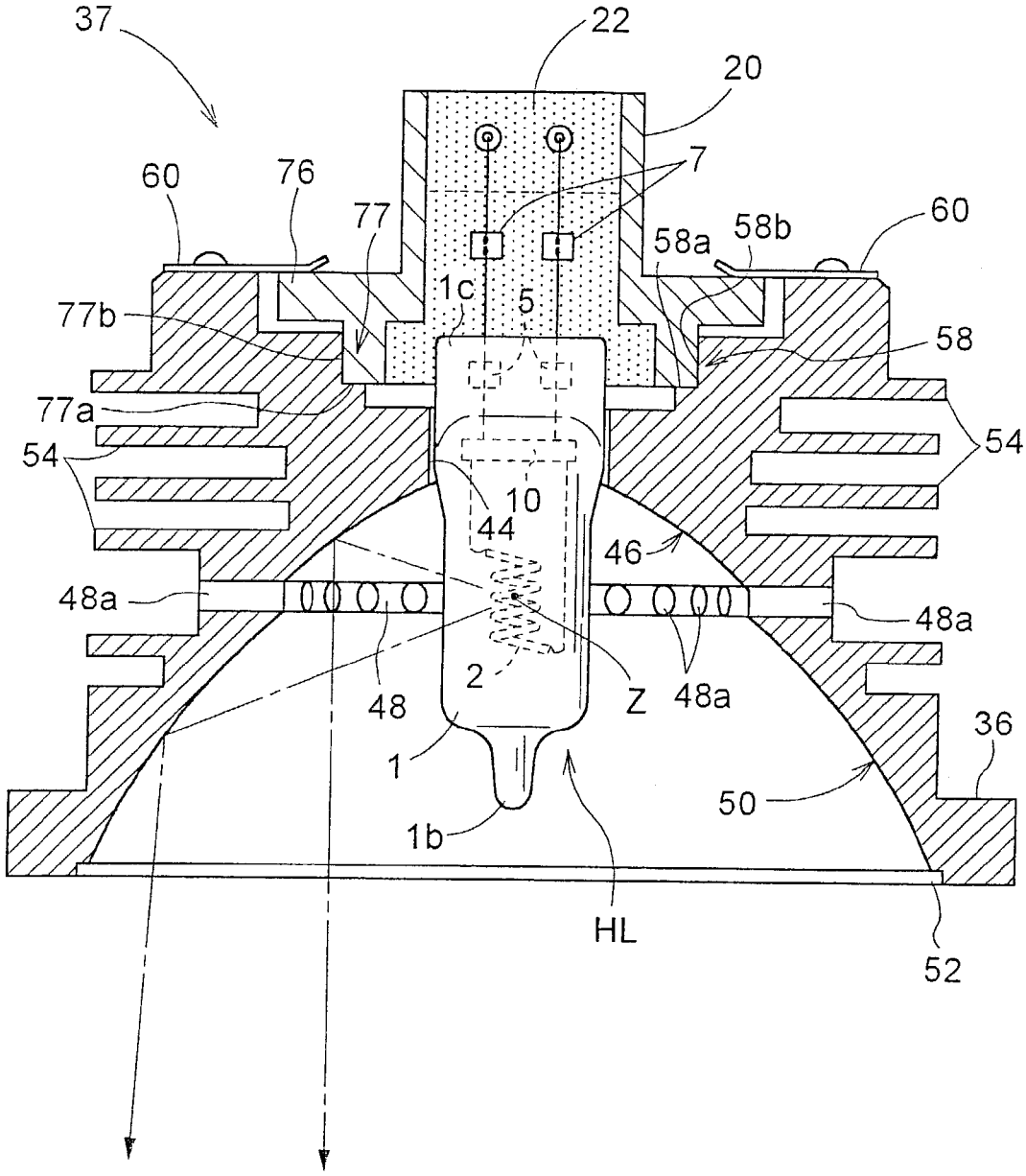
FIG. 8 is a partially cutaway front view showing a beam source unit employed in the silver salt photography digital printer shown in FIG. 7.

Between the illuminating optical system 26 and the imaging optical system 27, there is provided a film conveying mechanism 32 for feeding and holding a photographic film f on an optical path of the beam irradiated from the illuminating optical system 26. Further, a print-paper conveying mechanism 33 is provided for drawing the print paper P out of a paper magazine Pm and feeding it to the digital printing unit 30. And, the operations of these film conveying mechanism 32 and print-paper conveying mechanism 33 are controlled by the controller 29. The print paper P drawn out of the paper magazine Pm will be cut by a cutter (not shown) before or after its development, so as to provide the prints Ps each having one frame image. The illuminating optical system 26 includes, in addition to the beam source unit 37 described above, a beam-modulating filter 38 for appropriately modulating color distribution or intensity distribution of the beam from the beam source unit 37, a mirror tunnel 39, etc. and irradiates the photographic film f. The beam source unit 37 consists of the halogen lamp HL as a white beam source and a reflector 36. As shown in FIG. 8, the reflector 36 includes a reflecting face which is shaped like a downwardly opened bowl. The reflector 36 mounts the halogen lamp HL with allowing detachment of the lamp via the socket 20.

The reflector 36 forms, at the center thereof, a receiving recess 44 for receiving the glass bulb 1 of the halogen lamp HL (in this embodiment, the bulb 1 has an outer diameter of about 15 to 18 mm). Further, in order to minimize the gap to be formed relative to the glass bulb 1 so that such gap will not project its shadow on a target face to be irradiated, the receiving recess 44 has an inner diameter (e.g. about 20.5 mm) approximating the outer diameter of the glass bulb 1. The reflecting face extending radially outward and downward from the receiving recess 44 has a generally oval segment-like cross-sectional shape along a vertical plane extending through the axis thereof. Respecting this cross section, at a level agreeing to the incandescent center Z of the halogen lamp HL, there is formed an annular transition face 48 having a certain vertical extension.

As described hereinbefore with respect to the method of manufacturing the halogen lamp HL, when the base end 1*c* is fixed to the socket 20 with the refractory cement 22, the arrangement is made such that the incandescent center Z of the filament 2 would be set at a predetermined position relative to the socket 20. Therefore, the transition face 48 and the incandescent center Z of the halogen lamp HL would automatically be brought into level agreement with each other.

In this transition face 48, a plurality (twenty four of them in total) of exhaust through holes 48*a* extend horizontally and radially outward. The exhaust through hole 48*a* has an inner diameter of about 2 to 3 mm and a length of about 7 to 8 mm. As a result, the reflecting face is constituted from a first reflecting face 46 which extends radially inward from the exhaust through holes 48*a* to the receiving recess 44 and a second reflecting face 50 which extends radially outward from the exhaust through holes 48*a* to an outer edge 52. These reflecting faces 46, 50 include compensating means for compensating for irradiation lost in a low-irradiation area due to the formation of the exhaust through holes 48*a*. Specifically, in the present embodiment, in order to realize this compensating means, arrangement is made such that from a radially inward side toward outer side of the reflecting face, an angle of inclination relative to the incandescent center Z is varied across the exhaust through holes 48*a*. More particularly, the minor/major axis ratio (R1) of a first ellipse forming the first reflecting face 46 is set greater than the minor/major axis ratio (R2) of a second ellipse forming the second reflecting face 50. The ratio between R1 and R2 will be appropriately determined based on the distance from the reflector 36 to the target face to be irradiated.

With the function of this compensating means, a first irradiation area formed by the first reflecting face 46 on the irradiation target face and a second irradiation area formed by the second reflecting face 50 on the irradiation target face will be adjacent each other without interruption therebetween. As a result, irradiation may be provided in compensation to the portion (low-irradiation area) where the exhaust through holes 48*a* would project shadows thereof otherwise it if were not for such compensating means, such that no shadows will be formed and irradiating face providing more uniform irradiation may be formed. Incidentally, the incandescent center Z of the halogen lamp HL is substantially in agreement with both the foci of the ellipse forming the first reflecting face 46 and the foci of the ellipse forming the second reflecting face 50.

In other words, if the incandescent center Z of the halogen lamp HL were significantly displaced from the predetermined position relative to the socket 20 in the vertical direction in FIG. 3 and FIG. 8, this would result in non-uniformity in the illumination respecting the radial direction, which would lead in turn to a difference of light amount between the center and opposed ends of the CCD in the main scanning direction, so that high-precision image data could not be obtained. On the other hand, with the halogen lamp HL proposed by the present invention, as described hereinbefore, such problem will hardly occur since the incandescent center Z can be set precisely at the predetermined position relative to the socket 20.

The exhaust through hole 48*a* acts as a heat discharging means for discharging heat generated from the halogen lamp HL to the outside of the reflector 36 along the available current of ambient air. As another heat discharging means, the reflector 36 includes a reflector heat sink This heat sink comprises a plurality of first heat discharging fins 54 extending horizontally from the reflecting face to the opposite side thereof. The reflector 36 is formed with precision by the die-cast process in combination with polishing finish and the reflecting faces 46 and 50 are provided with required mirror faces by polishing finish or plating adapted for providing particularly high degree of flatness.

Figure 9:
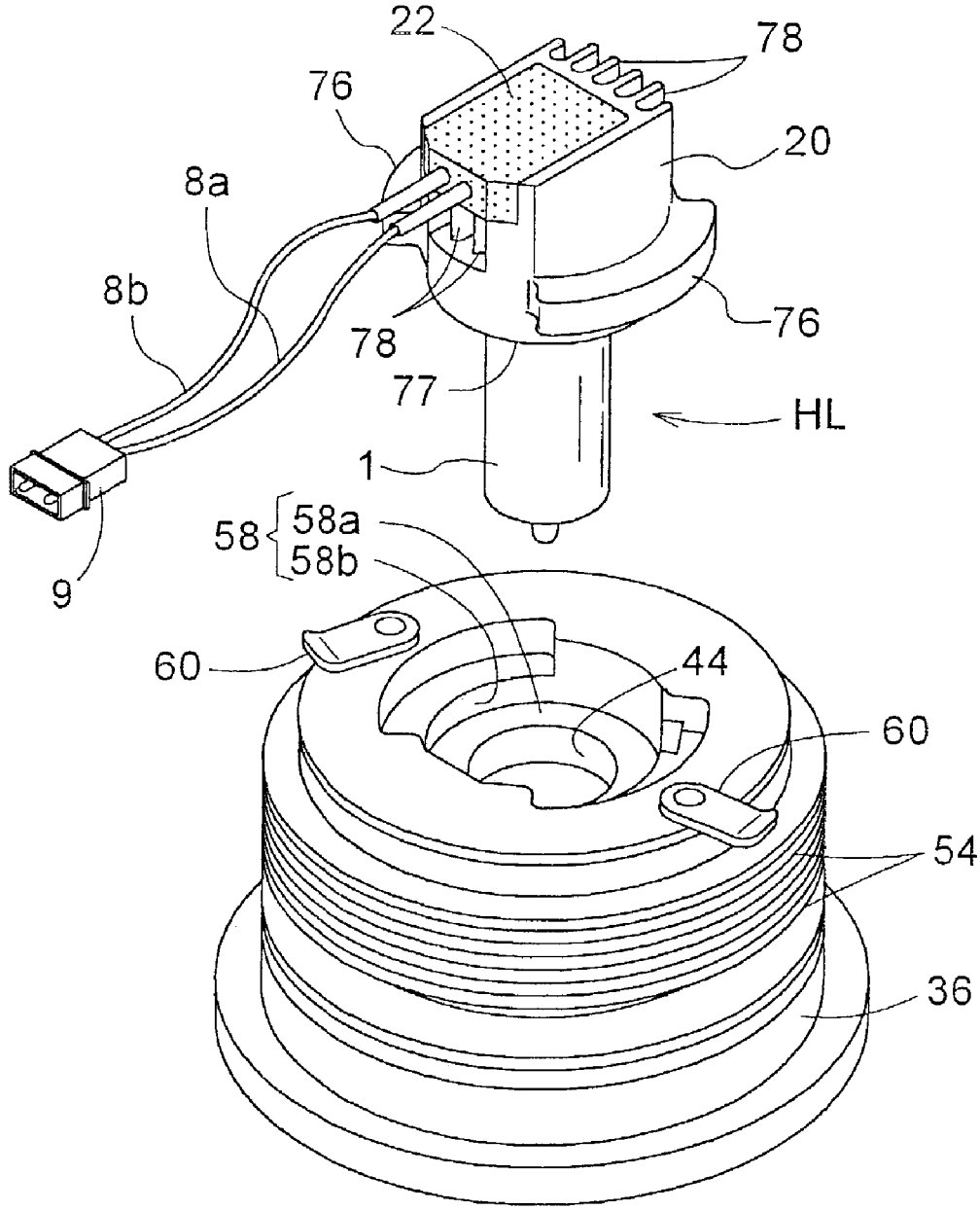
FIG. 9 is a perspective view showing the beam source unit employed in the silver salt photography digital printer shown in FIG. 7.
Figure 10:
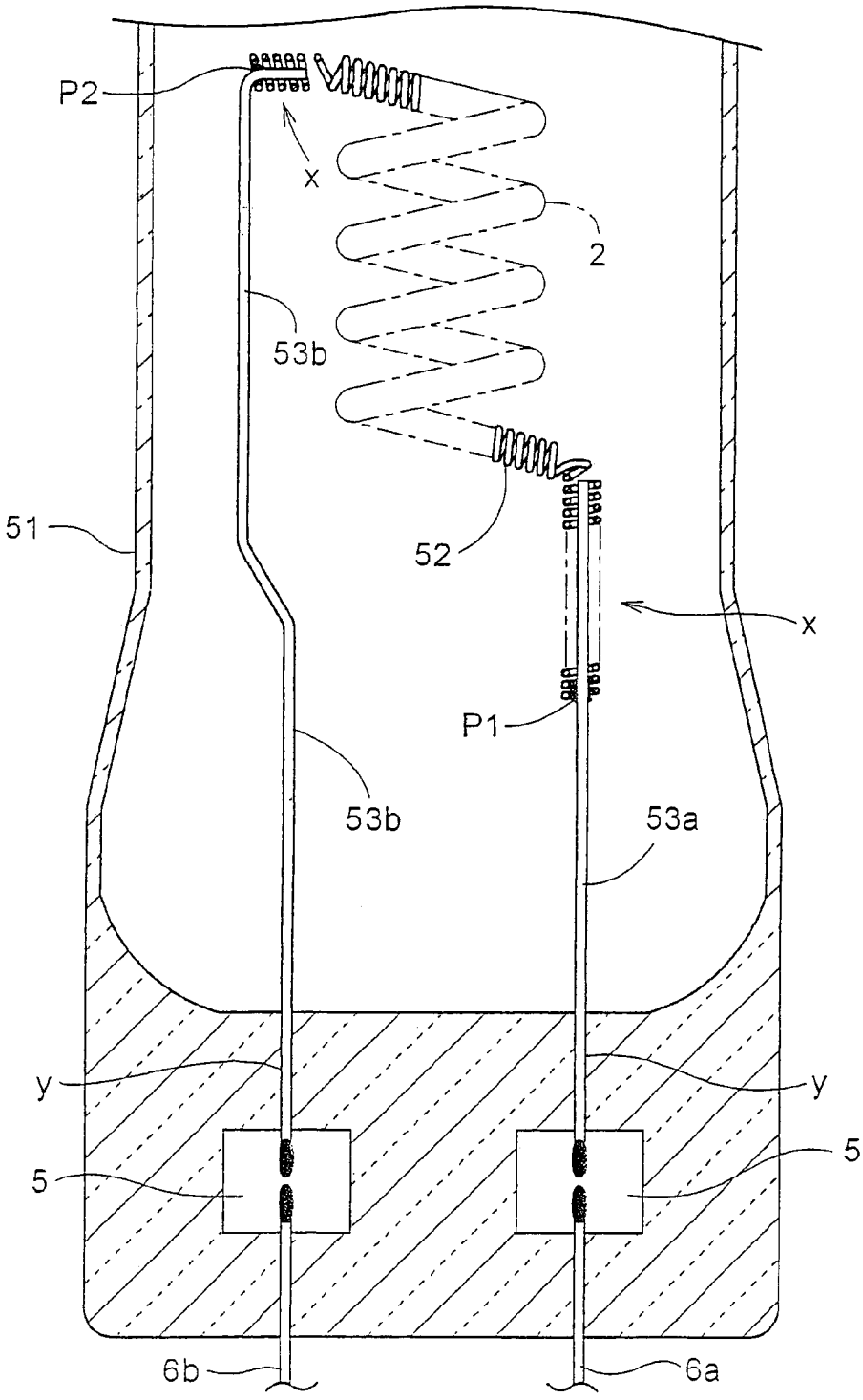
FIG. 10 is a partial enlarged view showing the conventional halogen lamp.

As shown in FIG. 1 and FIG. 9, the socket 20 includes, at the back side thereof a lamp heat sink as an integral part thereof. This lamp heat sink comprises a plurality of vertically extending second heat discharging fins 78.

Adjacent the bottom end of the socket 20, there are formed a first flange portion 76 having a large diameter and a second flange portion 77 having a smaller diameter than and projecting downward from the first flange portion 76.

And, an annular receiving recess 58 (consisting of a horizontally extending upper oriented face 58*a* and a vertically extending annular inner peripheral face 58*b*) formed in the reflector 36 is adapted for firmly receiving an outermost radial portion 77*a* formed by the horizontal bottom face of the second flange portion 77 of the socket and the vertically extending annular peripheral face 77*b*. This construction serves to allow the socket 20 of the halogen lamp HL to be supported constantly at and with the predetermined position and posture relative to the reflector 36.

The above construction further provides a heat transfer mechanism between the reflector 36 and the socket 20 through face contact of their horizontal and peripheral faces (i.e. the face contact between the outermost radial portion 77*a* of the horizontal bottom face and the upper oriented face 58*a* and the face contact between the outer peripheral face 77*b* and the inner peripheral face 58*b*). Accordingly, the heat generated from the halogen lamp HL per se may escape through the second heat discharging fins 78 to the outside of the lamp HL. On the other hand, there is provided also a heat discharging path for allowing discharge of the heat through the first heat discharging fins 54 to the outside of the reflector 36 which heat has been transferred to the reflector 36 by the heat transfer mechanism. Further, for the heat from the reflector 36 also, a heat discharge path is provided for allowing discharge of the heat through the second heat discharging fins 78 of the socket 20 to the outside of the halogen lamp HL which heat has been discharged from the exhaust through holes 48*a* and the first heat discharging fins 54 and transferred once to the socket 20 by the heat transfer mechanism.

At the top of the reflector 36, a pair of attaching pins 60 are provided for fixing the socket 20 against the upper oriented face 58*a*. The attaching pins 60 may comprise elastic material members such as plate members made of stainless steel. Then, the glass bulb 1 will be inserted into the receiving recess 44 and the second flange portion 77 of the socket 20 will be engaged with the receiving recess 58 of the reflector 36. Thereafter, the socket 20 will be turned clockwise by about 10 degrees while being pressed against the receiving recess 58. Whereby, the socket 20 will be fixed to the reflector 36.

Other embodiments of the invention will be described next.

In the foregoing embodiment, in the description of the method of manufacturing the halogen lamp HL, the step of bonding the filament 2 to the leading ends of the inner lead bars 3*a*, 3*b* is effected after the step of for fixedly interconnecting legs of the pair of lead members with the glass rod 10. This order may be reversed, i.e. the step for fixedly interconnecting the legs of the inner lead bars 3*a*, 3*b* with the glass rod 10 may be effected after the step for bonding the filament 2 to the leading ends of the inner lead bars 8*a*, 8*b* fixed to the jig.

Further, in the foregoing embodiment, the halogen lamp HL of the invention is used in the beam source unit 37 incorporated within the film scanner device 25 as one component of the silver photography digital printer 100. Instead, when the silver photography digital printer 200 implements the liquid crystal shutter type exposure engine in its digital printing unit 30, the invention's halogen lamp HL may be used as a beam source for such exposure engine also.

The invention may be embodied in any other way than described above with reference to the specific embodiments thereof without departing from its scope defined in the appended claims. Such modified constructions will all be apparent from those skilled in the art. The disclosed embodiments therefore should not be taken as limiting, but should be take only illustrative of the present invention.

The invention claimed is:

1. A halogen lamp comprising:

a pair of lead members;

a filament disposed between a pair of ends of the lead members;

bonding portions for bonding ends of said filament with the respective ends of the lead members;

a glass bulb encasing and sealing the filament and at least portions of the pair of lead members; and a support member made of non-conductive material and adapted for fixedly interconnecting legs of the pair of lead members, said support member being disposed within said glass bulb;

wherein the ends of said filaments and the ends of the lead members are welded to each other by heat fusion, so that said bonding portions are formed as spherical bonded portions free from projections of the ends of the filament or the lead members; and said filament and said lead members are in contact with each other only at said spherical bonded portions.

2. The halogen lamp according to claim 1, wherein said lead members and the filament are bonded together by plasma welding.

3. The halogen lamp according to claim 1, wherein during illumination of the halogen lamp, a halogen cycle is generated in which tungsten evaporated from the heated filament will react with the halogen gas within the glass bulb to form tungsten-halogen compound, which then will be decomposed in the vicinity of the filament and return thereto; and the support member is disposed out of a convection area of said compound in the halogen cycle.

4. The halogen lamp according to claim 1, wherein said filament comprises a double-helix construction formed by forming a small-diameter tungsten elongate element into a small-diameter helix and subsequently forming this small-diameter helix into a larger-diameter helix, with a center of the larger-diameter helix being disposed at the center of this glass bulb.

* * * * *